United States Patent [19]

Zitelli et al.

[11] Patent Number: 4,550,251

[45] Date of Patent: Oct. 29, 1985

[54] IMAGE INTENSIFIER TUBE WITH INCREASED CONTRAST RATIO

[75] Inventors: Louis T. Zitelli, Palo Alto; Richard T. Schumacher, Cupertino, both of Calif.

[73] Assignee: Varian Associates, Inc., Palo Alto, Calif.

[21] Appl. No.: 511,820

[22] Filed: Jul. 8, 1983

[51] Int. Cl.[4] ..... H01J 31/50

[52] U.S. Cl. ..... 250/213 VT; 313/105 CM

[58] Field of Search ..... 250/207, 227, 213 VT, 250/361, 486, 487; 313/524–530

[56] References Cited

U.S. PATENT DOCUMENTS

| | | | |
|---|---|---|---|
| 3,581,098 | 5/1971 | Hoover | 250/213 VT |
| 3,813,489 | 5/1974 | Ramsay et al. | 250/213 VT |
| 3,864,037 | 2/1975 | Johnson | 250/213 VT |
| 3,868,536 | 2/1975 | Enck, Jr. | 315/16 |
| 3,971,932 | 7/1976 | Sewell et al. | 250/213 VT |
| 4,031,552 | 6/1977 | Bosserman et al. | 313/105 CM |
| 4,076,978 | 2/1978 | Brennan et al. | 250/213 VT |
| 4,255,666 | 3/1981 | Wang et al. | 250/486 |

*Primary Examiner*—David C. Nelms

*Attorney, Agent, or Firm*—Stanley Z. Cole; Keiichi Nishimura; David Schnapf

[57] ABSTRACT

The contrast ratio of an image intensifier of the photocathode-amplifier-phosphor type is increased by using a fiber optic plate of which the thickness is reduced to such extent that the plate may not be able to function as a vacuum seal or an electrical insulator when a typical voltage for the operation of the intensifier is applied to the phosphor layer. This relatively thin fiber optic plate is placed entirely inside a vacuum, protected from the atmospheric pressure by a thick output window plate which is optically transparent.

18 Claims, 4 Drawing Figures

IMAGE INTENSIFIER TUBE WITH INCREASED CONTRAST RATIO

BACKGROUND OF THE INVENTION

This invention relates generally to an X-ray image intensifier tube and more particularly to a method of using a fiber optic plate to increase the contrast ratio of an X-ray image intensifier.

An image intensifier generally comprises a photocathode on which an input image is formed, an amplifying mechanism for enhancing the density of the beam of electrons emitted from the photocathode and an output assembly including a phosphor screen on which the electron beam strikes, converting its energy into visible light energy.

The contrast ratio of such an image intensifier tube is the ratio of brightness intensity observed at a specified place on the output phosphor screen with and without a lead disk of specified diameter placed at the input to obstruct incoming photons such as X-ray photons. The measurement may be made by obstructing the input surface only partially and comparing brightness in the unobstructed field and the image center of the lead disk.

One of the methods of improving the contrast ratio of an imaging device has been to use a fiber optic output faceplate together with a photocathode-amplifier-phosphor combination. An example of such an X-ray imaging device was disclosed in U.S. Pat. No. 4,142,101 issued Feb. 27, 1979 to L. I. Yin, and FIG. 1 schematically illustrates its output assembly 10. A flow of electrons from a photocathode means at the input end of the device strikes a phosphor layer 12 and the electron energy is converted back to light which is piped out for viewing by a fiber optic plate 13 with individual fibers aligned parallel to one another in the same direction as the electron flow. Contrast ratio is thereby enhanced because each fiber responds to the phosphor illumination on the electron-bombardment side and transmits it to the viewing side without substantial illumination of the adjacent fiber, or there is only a minimum of light "cross-talk" between fibers.

These elements 12 and 13 are contained within a housing 15 made of a material suitable for electrical insulation and vacuum isolation such as ceramic or glass. The phosphor layer 12 is connected to a pin 17 which protrudes from the housing 15 to provide a power supply connection. During a typical operation, the phosphor layer is at several kilovolts. The fiber optic plate 13 fused to the housing 15 along the edge of the output window so as to form a complete vacuum seal enclosing an evacuated area 19. Thus, the fiber optic plate 13 must also be able to function as an insulator because the housing 15 must be kept at ground potential during operation. The minimum thickness required of the fiber optic plate 13 to satisfy these conditions is about 5 mm. With thickness of this magnitude, however, both the probability of blemishes and light loss in the fiber optic increase and vacuum leaks still tend to occur.

SUMMARY OF THE INVENTION

It is therefore an object of this invention to provide an image intensifier tube with increased contrast ratio.

It is another object of this invention to provide a method of using a fiber optic plate to improve the contrast ratio of an image intensifier tube without increasing the probability of blemishes or light loss.

It is a further object of this invention to provide an X-ray image intensifier tube with a fiber optic plate which is not required to function either as an electrical insulator or a vacuum isolator.

DETAILED DESCRIPTION OF THE INVENTION

Figure 1:
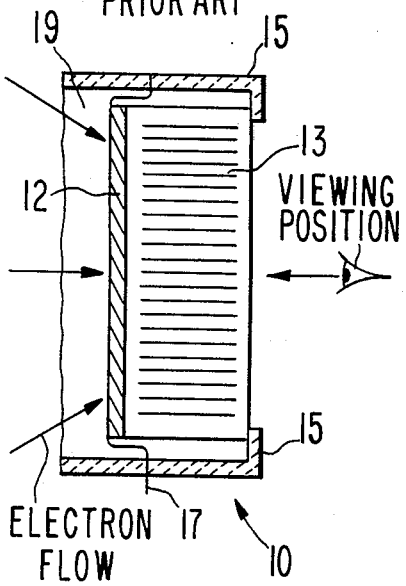
FIG. 1 PRIOR ART
FIG. 1 illustrates schematically a cross sectional view of a prior art output assembly of an X-ray image intensifier tube.
Figure 2:
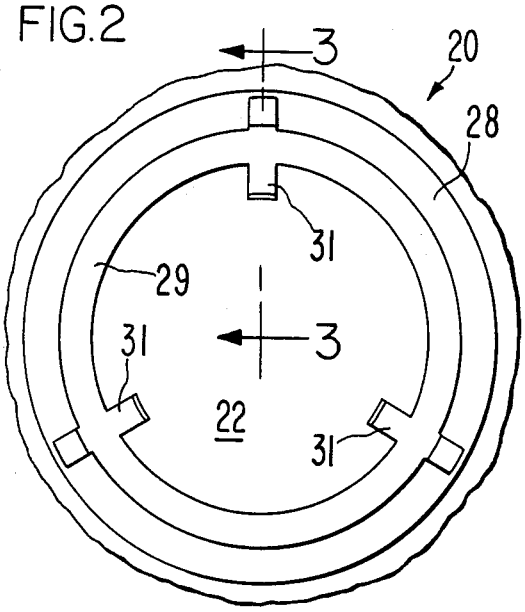
FIG. 2 is a plan view of an output assembly embodying the present invention.
Figure 3:
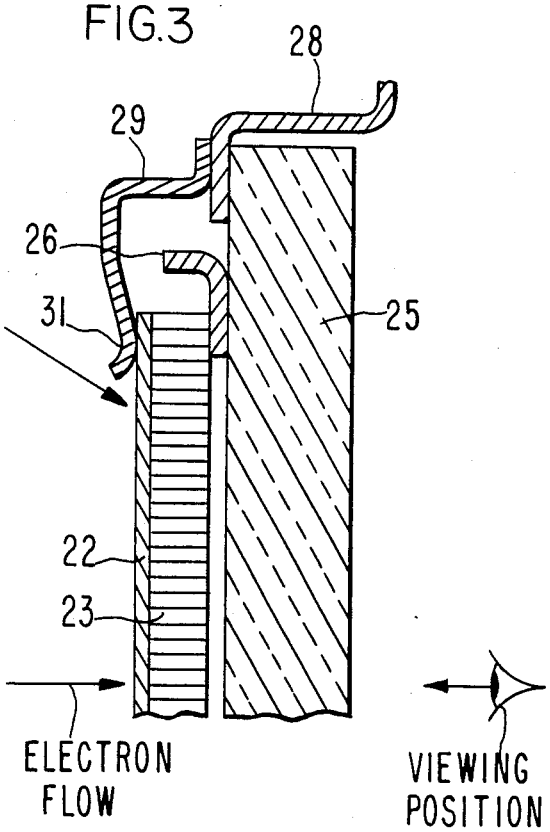
FIG. 3 is the cross sectional view of the output assembly of FIG. 2, taken along line 3—3 thereof.

FIGS. 2 and 3 show an output assembly 20 embodying the present invention for an image intensifier tube of the conventional photocathode-amplifier-phosphor type. FIG. 2 shows schematically the view of the assembly 20 as seen in the direction of the electrons impinging thereon, while FIG. 3 is a schematically drawn cross sectional view of the same, taken along line 3—3 of FIG. 2. Corresponding components in these two figures are indicated by the same numerals.

According to the present invention, the contrast ratio of an image intensifier tube is improved with minimum loss of light energy and without high probability of blemishes. This is achieved by applying a phosphor layer 22 on the electron-bombardment side of a fiber optic plate 23 of thickness which is much smaller than would be required if the same plate were either to be used as a part of an airtight housing enclosing an evacuated area or to be able to withstand a potential difference of several kilovolts between its surfaces. According to one embodiment of the present invention, the fiber optic plate 23 is a circular disk of about 44 mm in diameter and about 0.75 mm in thickness, disposed entirely inside the evacuated interior of an airtight housing (not shown).

The housing is provided with an output window 25 through which the image formed on the phosphor layer 22 can be viewed by a viewer outside the housing. The output window 25 is a solid glass plate which is about 2.25 mm in uniform thickness and is fused, or otherwise air-tightly joined to a flange 28 to form an output end section of the housing. The fiber optic plate 23 is positioned right inside, that is, on the vacuum side of the output window 25 in such a way that the back surface of the fiber optic plate 23 and the inner surface of the output window 25 are parallel to and facing each other, having three spacers 26 evenly distributed around the circular circumference of the fiber optic plate 23 to maintain a uniform separation distance therebetween. The thickness of these spacers 26, and hence also this uniform distance of separation, may be about 0.25 mm.

A retaining ring 29 is spot-welded to the flange 28. The ring 29 has a few (three in FIG. 2) arms 31 extended inward for pressing the fiber optic plate 23 against the spacers 26.

Figure 4:
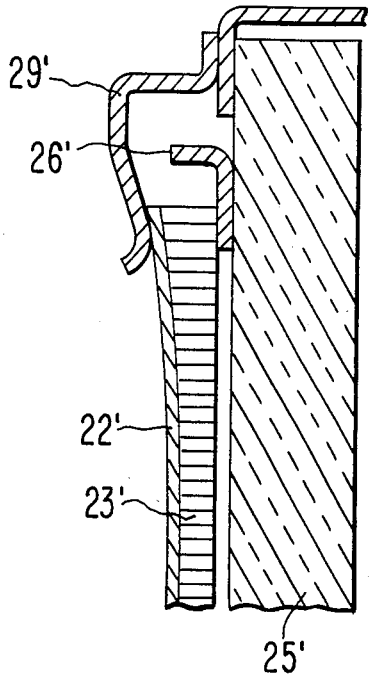
FIG. 4 is a schematic cross sectional view of an output assembly according to another embodiment of the present invention.

Another embodiment of the present invention is described in FIG. 4 wherein corresponding components are assigned the same numerals as in FIG. 3. According to this embodiment, the fiber optic plate 23' is made slightly thicker near the edges so as to form a plano-concave plate with the concave surface coated with a layer of phosphor 22' and facing the electron-bombardment side. Its plane surface faces the front surface of solid glass output window 25', separated by spacers 26' in the same way as shown in FIG. 3.

The present invention has been described above in terms of only a few embodiments. The description, however, is to be considered as illustrative rather than as limiting, and this invention is accordingly to be broadly construed. For example, the dimensions and distances given above are merely illustrative. The fiber optic plate 23 may be made thinner to further reduce light loss and probability of blemishes since it is intended to be neither a part of an airtight housing nor capable of withstanding a potential difference of several kilovolts between its surfaces. If strength is the desired feature, however, its thickness may be increased to the extent the user is willing to sacrifice certain other advantages. It is generally preferable that the thickness of the fiber optic plate 23 be less than a few millimeters, and more preferably less than 1 mm. The thickness of the output window 25, likewise, may be varied, depending on the circumstances of application. In view of the positive voltage of typically a few kilovolts which may be applied to the phosphor layer 22 and the fact that the relatively thin fiber optic plate 23 is not expected to function as a dependable insulator, the output window 25 must be sufficiently thick to protect the viewer at ground potential who may come in contact with the external surface of the housing and/or the output window 25. The preferable thickness under typical conditions may be from a few to several millimeters. The output window 25, furthermore, need not be made of glass. Any other optically transparent substance which is an electrical insulator and vacuum isolator can be substituted. The scope of the present invention is defined only by the following claims.

What is claimed is:

1. An image intensifier tube with improved contrast ratio, comprising:

a photocathode for emitting a flow of electrons, a means for intensifying said flow of electrons, an air-tight housing for containing an evacuated area, an output window plate which is transparent to light and forms a part of said air-tight housing, and a fiber optic plate having a front surface with a phosphor layer which emits light when struck by said electrons and a back surface adjacent said output window, said fiber optic plate being entirely within said evaucated area.

2. The image intensifier tube of claim 1 wherein said front surface is flat.

3. The image intensifier tube of claim 1 wherein the thickness of said fiber optic plate is selected to be a value sufficient to provide mechanical rigidly required during manufacturing of said tube.

4. The image intensifier tube of claim 1 wherein said fiber optic plate is less than 1 mm in thickness.

5. The image intensifier tube of claim 1 further comprising spacer means between said back surface and said output window, and means for pressing said fiber optic plate against said spacer means so that a uniform distance is maintained between said fiber optic plate and said output window.

6. The image intensifier tube of claim 5 wherein said uniform distance is about 0.25 mm.

7. The image intensifier tube of claim 5 wherein the thickness of said fiber optic plate is less than 1 mm.

8. The image intensifier tube of claim 1 wherein said output window plate is solid glass.

9. The image intensifier tube of claim 1 wherein said output window plate is greater than 1.5 millimeters in thickness.

10. The image intensifer tube of claim 1 further including a means for maintaining said phosphor layer at a positive potential with respect to ground.

11. The image intensifier tube of claim 1 wherein said fiber optic plate is plano-concave.

12. An output assembly for an image intensifier comprising a optically transparent plate having an internal surface defining a boundary of an evacuated interior area of said image intensifier and an external surface exposed to atmospheric pressure, and a fiber optic plate of less than 1 mm in thickness between a front surface and a back surface thereof for improving contrast ratio of said image intensifier, said front surface being covered with a phosphor layer, and said back surface facing said internal surface.

13. The assembly of claim 12 wherein said fiber optic plate is completely within said evacuated interior.

14. The assembly of claim 12 wherein said back surface and said internal surface are flat and parallel to each other, separated by a uniform distance of less than 1 mm.

15. The assembly of claim 12 wherein said front surface is flat.

16. The assembly of claim 12 wherein said front surface is concave.

17. The assembly of claim 12 further comprising spacers for maintaining a desired distance between said back surface and said internal surface.

18. The assembly of claim 12 wherein said optically transparent plate is an electrical insulator capable of withstanding a potential difference of several kilovolts across surfaces thereof.

* * * * *